US011768510B2

(12) United States Patent
Sakurai et al.

(10) Patent No.: US 11,768,510 B2
(45) Date of Patent: Sep. 26, 2023

(54) POWER SUPPLY SEMICONDUCTOR INTEGRATED CIRCUIT INCLUDING A SHORT-CIRCUIT-FAULT DETECTION CIRCUIT THAT DETECTS A SHORT CIRCUIT OF THE VOLTAGE-OUTPUT TERMINAL

(71) Applicants: Kohei Sakurai, Atsugi (JP); Shinichiro Maki, Hiratsuka (JP)

(72) Inventors: Kohei Sakurai, Atsugi (JP); Shinichiro Maki, Hiratsuka (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 224 days.

(21) Appl. No.: 17/458,048

(22) Filed: Aug. 26, 2021

(65) Prior Publication Data

US 2022/0075403 A1 Mar. 10, 2022

(30) Foreign Application Priority Data

Sep. 7, 2020 (JP) ..... 2020-149739

(51) Int. Cl.
*G05F 1/575* (2006.01)
*G05F 1/571* (2006.01)
(Continued)

(52) U.S. Cl.
CPC ..... *G05F 1/575* (2013.01); *G05F 1/571* (2013.01); *G05F 1/573* (2013.01); *G05F 3/262* (2013.01)

(58) Field of Classification Search
CPC ..... G05F 1/575; G05F 1/571; G05F 1/573; G05F 3/262
See application file for complete search history.

(56) References Cited

U.S. PATENT DOCUMENTS 8,450,982 B2 * 5/2013 Matsuda ..... H02J 7/007192 320/152
8,847,569 B2 9/2014 Terada et al.
(Continued)

FOREIGN PATENT DOCUMENTS

EP 3301537 A1 * 4/2018 ..... G05F 1/56
JP 2017045096 A 3/2017
(Continued)

OTHER PUBLICATIONS

U.S. Appl. No. 17/458,113, First Named Inventor: Kohei Sakurai; Title: "Power Supply Semiconductor Integrated Circuit"; filed Aug. 26, 2021.

*Primary Examiner* — Sisay G Tiku
(74) *Attorney, Agent, or Firm* — Holtz, Holtz & Volek PC

(57) ABSTRACT

A power supply semiconductor IC includes: an output transistor connected between a voltage-input terminal and a voltage-output terminal; a control circuit that controls the output transistor based on a feedback voltage of an output voltage; a current-limit circuit that limits an output current of the output transistor such that the output current is not equal to or greater than a current limit; a first transistor constituting a current-mirror circuit with the output transistor; a short-circuit-fault detection circuit that detects a short circuit of the voltage-output terminal based on a voltage across a resistor connected in series to the first transistor; and a first output terminal that outputs a detection result of the short-circuit-fault detection circuit. The current limit is within a detection range of the short-circuit-fault detection circuit. The short-circuit-fault detection circuit detects a short circuit of the voltage-output terminal even while the current limit circuit limits the output current.

10 Claims, 5 Drawing Sheets

(51) Int. Cl.
*G05F 1/573* (2006.01)
*G05F 3/26* (2006.01)

(56) References Cited

U.S. PATENT DOCUMENTS

| | | | | |
|---|---|---|---|---|
| 9,996,093 | B2 | 6/2018 | Takano et al. | |
| 10,063,135 | B2 | 8/2018 | Maki et al. | |
| 2013/0002220 | A1* | 1/2013 | Terada | G05F 1/56 323/282 |
| 2016/0197554 | A1* | 7/2016 | Sakurai | G01R 19/00 323/271 |
| 2017/0063232 | A1 | 3/2017 | Takano et al. | |
| 2018/0097439 | A1 | 4/2018 | Maki et al. | |
| 2019/0179352 | A1 | 6/2019 | Sakurai | |
| 2020/0371538 | A1 | 11/2020 | Maki et al. | |
| 2021/0191440 | A1 | 6/2021 | Takano et al. | |
| 2022/0074973 | A1* | 3/2022 | Takano | G01R 19/16571 |
| 2022/0075004 | A1* | 3/2022 | Sakurai | G01R 19/16576 |
| 2022/0075403 | A1* | 3/2022 | Sakurai | G05F 1/571 |
| 2022/0182049 | A1* | 6/2022 | Takano | H03K 17/0822 |

FOREIGN PATENT DOCUMENTS

| | | | | |
|---|---|---|---|---|
| JP | 2018055545 | A | 4/2018 | |
| JP | 2021096674 | A * | 6/2021 | G05F 1/445 |
| JP | 2022044133 | A * | 3/2022 | G01R 19/16576 |
| WO | WO-2011102189 | A1 * | 8/2011 | G05F 1/573 |

* cited by examiner

POWER SUPPLY SEMICONDUCTOR INTEGRATED CIRCUIT INCLUDING A SHORT-CIRCUIT-FAULT DETECTION CIRCUIT THAT DETECTS A SHORT CIRCUIT OF THE VOLTAGE-OUTPUT TERMINAL

CROSS-REFERENCE TO RELATED APPLICATIONS

The entire disclosure of Japanese Patent Application No. 2020-149739 filed on Sep. 7, 2020 is incorporated herein by reference in its entirety.

BACKGROUND

Technical Field

The present disclosure relates to a technology that is effectively applied to a power supply semiconductor integrated circuit (power supply IC) that constitutes a voltage regulator, such as a series regulator for converting a DC voltage, or a power supply switch for applying the voltage of a power supply device without change to a load and shutting down the voltage to the load.

Background

A series regulator (hereinafter called regulator) is known as a power supply device that controls a transistor provided between a DC voltage input terminal and an output terminal and that outputs a DC voltage at desired electronic potential.

An onboard regulator is usually connected via a connector to an onboard electronic device, such as a car navigation device. The connector may be disconnected from the power supply owing to shakings of the vehicle, leaving the output terminal of the power supply open. Further, a short circuit may occur in the electronic device as a load. An onboard regulator is therefore required to detect such faults.

For example, JP2017-45096A and JP2018-55545A disclose an invention that relates to a semiconductor integrated circuit for a regulator (regulator IC), as shown in FIG. 8. The regulator IC includes a comparator CMP1 that detects an open circuit of the output terminal and a comparator CMP2 that detects a short circuit, and is configured to generate fault detection signals Err_op, Err_sc and from output terminals.

The invention in JP2017-45096A and JP2018-55545A also discloses an embodiment of a regulator IC (FIG. 8) including a thermal shutdown circuit that stops operation of an error amplifier when the temperature of the chip reaches a predetermined level or higher. The OR gate 18 calculates the logical sum of the output of the comparator CMP2 for detecting a short-circuit fault and the output of the thermal shutdown circuit TSD to turn on/off the transistor Q6, thereby outputting the fault detection signal Err_sc.

SUMMARY

The regulator IC shown in FIG. 8 includes terminals P1, P2 to be connected to an external resistor Rop for detecting an open-circuit fault and an external resistor Rsc for detecting a short-circuit fault. When the terminals P1, P2 are properly connected to the resistors Rop, Rsc, the regulator IC outputs the fault detection signals Err_op, Err_sc as shown in the following Table 1, on the basis of the detection.

However, when the external resistor Rop for detecting an open-circuit fault is disconnected from the terminal P1, the regulator IC outputs the fault detection signals Err_op, Err_sc shown in Table 2. When the external resistor Rsc for detecting a short-circuit fault is short-circuited, the regular IC outputs the fault detection signals Err_op, Err_sc shown in Table 3.

TABLE 1

| | RESISTOR Rop, RESISTOR Rsc: NO FAULT | | | |
|---|---|---|---|---|
| | OUTPUT: NORMAL | OUTPUT: OPEN | OUTPUT: SHORT | OPERATION OF TSD |
| Err_op | H | L | H | L |
| Err_sc | H | H | L | L |

TABLE 2

| | RESISTOR Rop: OPEN-CIRCUIT FAULT | | | |
|---|---|---|---|---|
| | OUTPUT: NORMAL | OUTPUT: OPEN | OUTPUT: SHORT | OPERATION OF TSD |
| Err_op | H | H | H | H |
| Err_sc | H | H | L | L |

TABLE 3

| | RESISTOR Rsc: SHORT-CIRCUIT FAULT | | | |
|---|---|---|---|---|
| | OUTPUT: NORMAL | OUTPUT: OPEN | OUTPUT: SHORT | OPERATION OF TSD |
| Err_op | H | L | H | L |
| Err_sc | H | H | H | T |

Compare Table 1 and Table 2. When the thermal shutdown circuit TSD is active while the external resistor Rop is disconnected from the terminal P1, the regulator Ic outputs "H, L" as the fault detection signals Err_op, Err_sc, as shown in Table 2, although the regulator IC should output "L, L" as shown in Table 1. Further, compare Table 1 and Table 3. When the external resistor Rsc for detecting a short-circuit fault is short-circuited and a short circuit occurs at the output terminal or in a load device, the regulator IC outputs "H, H" as the fault detection signals Err_op, Err_sc as shown in Table 3, although the regulator Ic should output "H, L" as shown in Table 1. That is, although a fault occurs, the regulator IC wrongly notifies that the IC is in a normal state.

Failure to correctly notify that the thermal shutdown circuit TSD is active and that an output terminal is short-circuited can be fatal for the power supply device and should be avoided. In reference to Table 2, when the external resistor Rop is open and an open-circuit fault occurs at the output terminal, the regulator IC outputs "H, H", although the regulator IC should output "L, H". An open-circuit fault at the output terminal, however, only leaves the load device inoperative. Therefore, failure to detect an open circuit at the output terminal is not fatal for the power supply device and therefore may be allowed.

The present invention has been conceived in view of the above issues. Objects of the present invention include providing a power supply IC (e.g., regulator IC, power-supply switch IC) that includes a circuit configured to detect a short-circuit fault of an output terminal and a thermal shutdown circuit and that can avoid failing to notify operation of the thermal shutdown circuit and a short circuit of the output terminal when an external resistor is not connected to its corresponding terminal.

The objects of the present invention further include enabling use of a current limit circuit having a foldback current limit characteristic in a power supply regulator (regulator IC, power supply switch IC).

To achieve at least one of the abovementioned objects, according to an aspect of the present invention, there is provided a power supply semiconductor integrated circuit including: an output transistor connected between a voltage-input terminal to which a DC voltage is input and a voltage-output terminal; a control circuit that controls the output transistor based on a feedback voltage of an output voltage; a current limit circuit that limits an output current of the output transistor such that the output current is not equal to or greater than a predetermined current limit; a first transistor, the first transistor and the output transistor constituting a current mirror circuit; a short-circuit-fault detection circuit that detects a short circuit of the voltage-output terminal based on a voltage across a resistor element connected in series to the first transistor; and a first output terminal that outputs a detection result of the short-circuit-fault detection circuit to outside, wherein the current limit of the current limit circuit is within a current detection range of the short-circuit-fault detection circuit, and the short-circuit-fault detection circuit is capable of detecting a short circuit of the voltage-output terminal even while the current limit circuit is limiting the output current.

BRIEF DESCRIPTION OF DRAWINGS

The accompanying drawings are not intended as a definition of the limits of the invention but illustrate embodiments of the invention, and together with the general description given above and the detailed description of the embodiments given below, serve to explain the principles of the invention, wherein.

DESCRIPTION OF EMBODIMENTS

Hereinafter, one or more embodiments of the present invention are described with reference to the drawings. However, the present invention is not limited to the disclosed embodiments.

Figure 1:
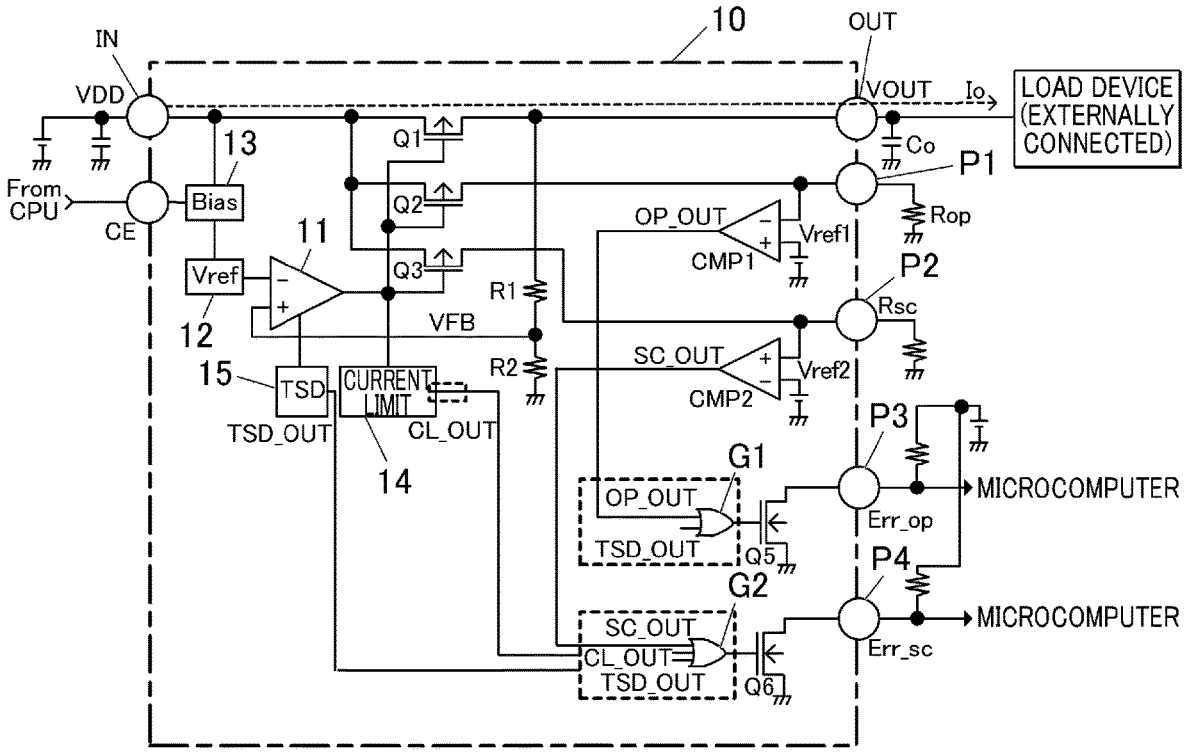
FIG. 1 shows a circuit configuration of a regulator IC as an embodiment of the present invention.

FIG. 1 shows an embodiment of a series regulator as a DC power supply device to which the present invention is applied. In FIG. 1, the region enclosed by the alternate long and short dash line is a semiconductor integrated circuit (regulator IC) 10 formed on a semiconductor chip, such as a single crystal silicon. The output terminal OUT of the regulator IC 10 is connected to a capacitor Co. The regulator IC 10 functions as a DC power supply device that supplies a stable DC voltage.

As shown in FIG. 1, in the regulator IC 10 in this embodiment, a voltage-control MOS transistor Q1 (herein, P-channel MOS transistor) is connected between a voltage-input terminal IN to which a DC voltage VDD is applied and a voltage-output terminal OUT, and bleeder resistors R1, R2 for dividing an output voltage Vout are connected in series between the voltage-output terminal OUT and a ground line to which a ground potential GND is applied.

The voltage VFB divided by the resistors R1, R2 for dividing the output voltage is applied as feedback voltage to a non-inverting input terminal of an error amplifier 11. The error amplifier 11 is an error amplifier circuit that controls a gate terminal of the voltage-control transistor Q1. On the basis of the potential difference between the feedback voltage VFB of the output and a predetermined reference voltage Vref, the error amplifier 11 controls the voltage-control transistor Q1 such that the output voltage Vout is at a desired potential.

The regulator IC 10 in this embodiment further includes: a voltage reference circuit 12 that generates the reference voltage Vref to be applied to the inverting input terminal of the error amplifier 11; a bias circuit 13 that supplies operation currents to the error amplifier 11 and the voltage reference circuit 12; a current limit circuit 14 that is connected to the gate terminal of the voltage-control transistor Q1 and that limits output currents; and a thermal shutdown circuit 15 that stops operation of the error amplifier 11 to turn off the transistor Q1 when the temperature of the chip is equal to or higher than a predetermined temperature. CE is an external terminal to which signals for turning on/off the regulator IC are input.

The voltage reference circuit 12 can be constituted of resistors connected in series or a Zener diode. The bias circuit 13 has a function of supplying/stopping supplying bias currents to the error amplifier 11 according to control signals input to the external terminal CE by, for example, an external microcomputer (CPU). When a fault in a load increases the output current and decreases the output voltage, the error amplifier 11 tries to decrease the gate voltage so that more currents flow through the transistor Q1. In such a case, the current limit circuit 14 performs clamping to prevent increase of a drain current to a predetermined level or higher, thereby limiting the output current Io.

The regulator IC 10 in this embodiment further includes transistors Q2, Q3 connected in parallel with the voltage-control transistor Q1. The transistors Q1, Q2, Q3 constitute a current mirror circuit. The gate terminals (control terminals) of the transistors Q2, Q3 receive the same voltage as the voltage applied to the gate terminal of the voltage-control transistor Q1. Accordingly, currents that flow through the transistors Q2, Q3 correspond to the element size ratios N of the transistors Q2, Q3 to the transistor Q1 and are therefore proportional (1/N current) to the drain current of the transistor Q1. When the transistor Q1 consists of N transistors having the same size connected in parallel (N is the number of transistors) and the transistors Q2, Q3 each consist of a single transistor, the currents flowing these transistors are proportional to the number of elements.

The regulator IC 10 in this embodiment further includes an external terminal P1 and an external terminal P2. The external terminal P1 connects to a resistor Rop for converting currents into voltages outside the chip. The external terminal P2 connects to a resistor Rsc. The drain terminal of the current-mirror transistor Q2 is connected to the external terminal P1. The drain terminal of the current-mirror transistor Q3 is connected to the external terminal P2.

The regulator IC 10 further includes a comparator CMP1 for detecting an open-circuit fault and a comparator CMP2 for detecting a short-circuit fault. The inverting input terminal of the comparator CMP1 is connected to the external terminal P1, and the non-inverting input terminal of the comparator CMP1 receives a reference voltage Vref1. The non-inverting input terminal of the comparator CMP2 is connected to the external terminal P2, and the inverting input terminal of the comparator CMP2 receives the reference voltage Vref2. The comparator CMP1 for detecting an open-circuit fault and the comparator CMP2 for detecting a short-circuit fault have hysteresis. This, however, does not limit the present invention.

The resistivity of the external resistor Rop is set such that the voltage between the terminals of the resistor Rop becomes equal to the reference voltage Vref1 when a relatively small detection current indicating an open circuit flows through the voltage-control transistor Q1. The resistivity of the external resistor Rsc is set such that the voltage between the terminals of the resistor Rsc becomes equal to the reference voltage Vref2 when a relatively large detection current indicating a short-circuit fault flows through the voltage-control transistor Q1.

Thus, in this embodiment, current values for detecting an open-circuit fault and a short-circuit fault are set using the external resistors Rop, Rsc. These current values (thresholds) for detection can be set as desired depending on the system used. Further, the reference voltage Vref1 of the comparator CMP1 and the reference voltage Vref2 of the comparator CMP2 may be the same or different. This can simplify a circuit for generating the reference voltage.

The regulator IC 10 in this embodiment further includes an OR gate 1 and an OR gate 2. The OR gate 1 calculates a logical sum of the output of the comparator CMP1 (OP_OUT) and the output of the thermal shutdown circuit 15 (TSD_OUT). The OR gate 2 calculates a logical sum of the output of the comparator CMP2 (SC_OUT), the output of the current limit circuit 14 (CL_OUT), and the output of the thermal shutdown circuit 15 (TSD_OUT). The output CL_OUT of the current limit circuit 14 indicates that the current limit circuit 14 is active. The output TSD_OUT of the thermal shutdown circuit 15 indicates that the thermal shutdown circuit 15 is active.

The regulator IC 10 further includes an N-channel MOS transistor Q5 and an N-channel MOS transistor Q6. The gate terminal of the transistor Q5 receives the output of the OR gate G1. The gate terminal of the transistor Q6 receives the output of the OR gate G2. The regulator IC 10 further includes external terminals P3, P4 for outputting signals to an external CPU or other devices with the open-drain method. The drain terminal of the transistor Q5 is connected to the external terminal P3, and the drain terminal of the transistor Q6 is connected to the external terminal P4.

Figure 8:
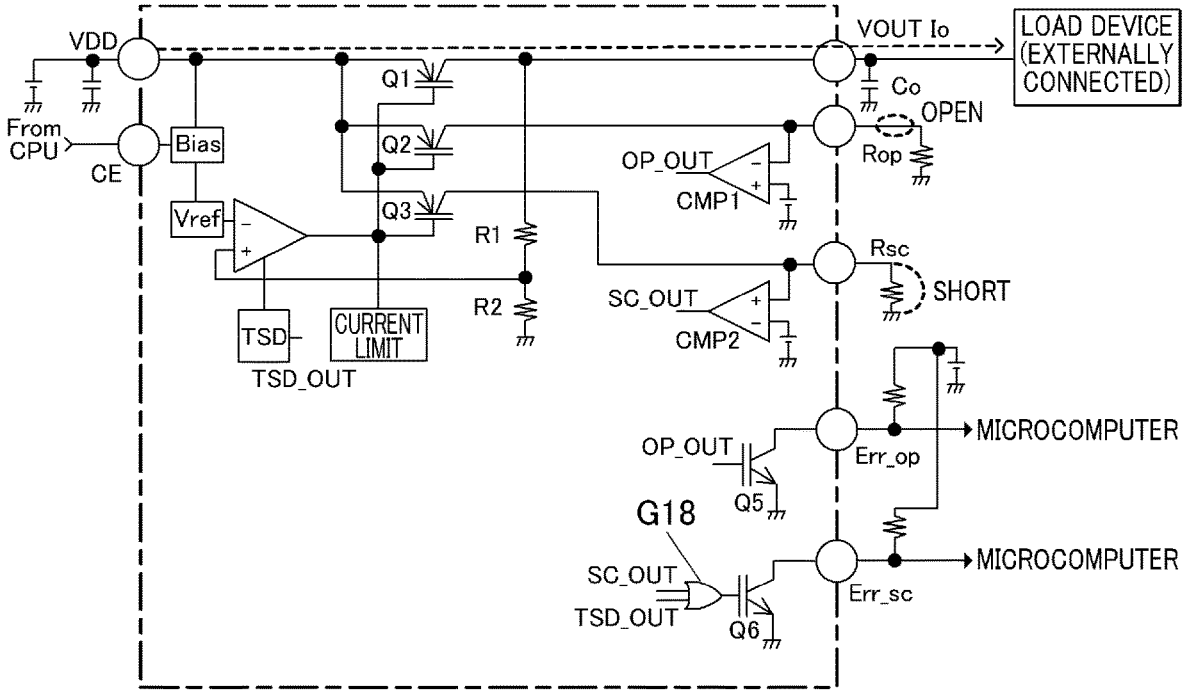
FIG. 8 PRIOR ART
FIG. 8 shows an example circuit configuration of a known regulator IC.

Referring to the known IC in FIG. 8, when the thermal shutdown circuit TSD is active, the known IC should output "H, L" as the fault detection signals Err_op, Err_sc as shown in Table T1. However, when the thermal shutdown circuit TSD is active while the external resistor Rop for detecting an open circuit is not connected to the terminal P1, the known IC outputs "H, L" as shown in Table T2.

The regulator IC 10 in this embodiment, on the other hand, includes the OR gate G1 that calculates the logical sum of the output OP_OUT of the comparator CMP1 and the output TSD_OUT of the thermal shutdown circuit 15, as described above. Thus, the regulator IC 10 can output "L, L" as the fault detection signals Err_op, Err_sc, as shown in Table 4 when the external resistor Rop is not connected to the terminal P1 and the thermal shutdown circuit 14 is active.

Further, when a short-circuit fault occurs at the output terminal, the known IC in FIG. 8 should output "H, L" as the fault detection signals Err_op, Err_sc, as shown in Table T1.

However, when a short-circuit fault occurs at the output terminal while the external resistor Rsc for detecting the short circuit is short-circuited, the known IC of FIG. 8 outputs "H, H" as shown in Table T3.

In the regulator IC 10 in this embodiment, the output CL_OUT of the current limit circuit 14 is input to the OR gate G2. Accordingly, the current limit circuit 14 is active while the output terminal OUT is short-circuited. This allows the regulator IC 10 to output "H, L" as the fault detection signals Err_op, Err_sc regardless of the output SC_OUT of the comparator CMP2, as shown in Table 5.

TABLE 4

| | RESISTOR Rop: OPEN-CIRCUIT FAULT | | | |
|---|---|---|---|---|
| | OUTPUT: NORMAL | OUTPUT: OPEN | OUTPUT: SHORT | OPERATION OF TSD |
| Err_op | H | H | H | L |
| Err_sc | H | H | L | L |

TABLE 5

| | RESISTOR Rsc: SHORT-CIRCUIT FAULT | | | |
|---|---|---|---|---|
| | OUTPUT: NORMAL | OUTPUT: OPEN | OUTPUT: SHORT | OPERATION OF TSD |
| Err_op | H | L | H | L |
| Err_sc | H | H | L | L |

Figure 2A:
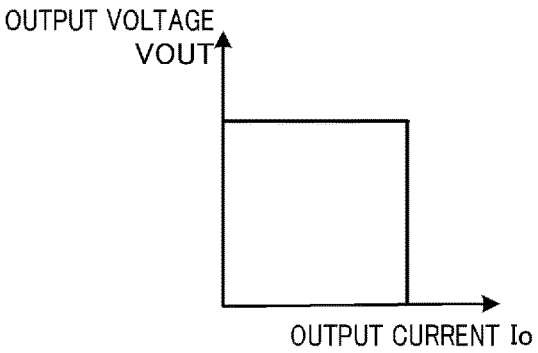
FIG. 2A PRIOR ART
FIG. 2A shows a characteristic of a current limit circuit of a known regulator IC.
Figure 2B:
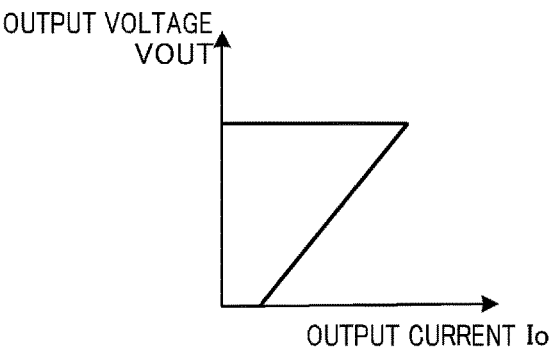
FIG. 2B shows a characteristic of a current limit circuit constituting the regulator IC in the embodiment.

Further, when the output terminal OUT is short-circuited and the current limit circuit 14 limits the output current Io according to the foldback current limiting characteristic as shown in FIG. 2B, the regulator IC 10 in this embodiment can output a low-level fault detection signal Err_sc, on the basis of CL_OUT output by the current limit circuit 14. Accordingly, the actual usage range of the output current Io can be widened. The reason of this is described below.

When the current limit value is within the detection range of the short-circuit-fault detection circuit (comparator CMP2) having hysteresis, the known regulator IC in FIG. 8 cannot correctly detect and notify a short-circuit fault of the output terminal owing to the operation of the current limit circuit. Therefore, the current limit value needs to be far greater than the short detection range, and the current limit circuit needs to have a dropping characteristic in limiting currents, as shown in FIG. 2A.

Figure 3A:
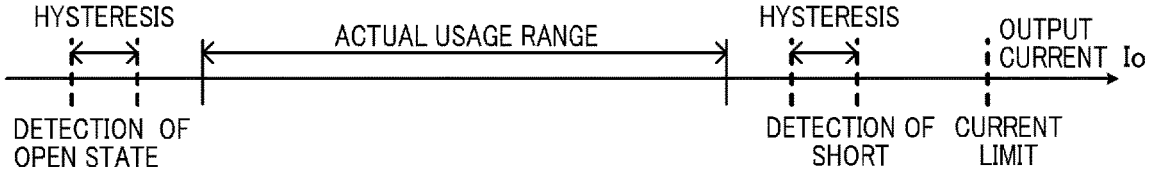
FIG. 3A PRIOR ART
FIG. 3A shows a relation between a short detection range and a current limit value of a known regulator IC.
Figure 3B:
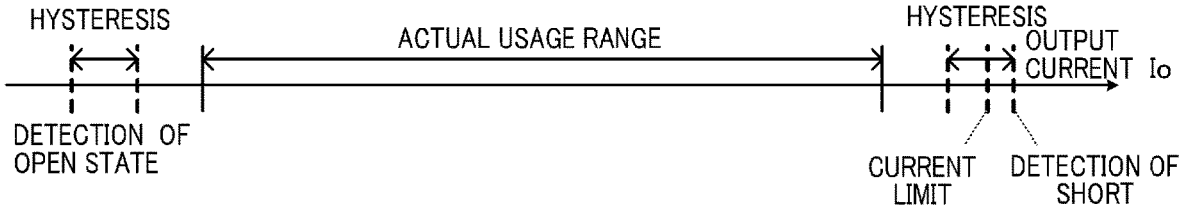
FIG. 3B shows a relation between a short detection range and a current limit value of the regulator in the embodiment.

The regulator IC 10 in this embodiment, on the other hand, can correctly detect and notify a short-circuit fault of the output terminal even while the current limit circuit 14 is active. This allows the current limit value to be within the short-circuit-fault detection range. Accordingly, the actual usage range of the output current Io can be widened, as shown in FIG. 3B. As the regulator IC 10 uses the current limit circuit 14 having the foldback current limiting characteristic, the load device can be protected from an overcurrent.

Figure 4:
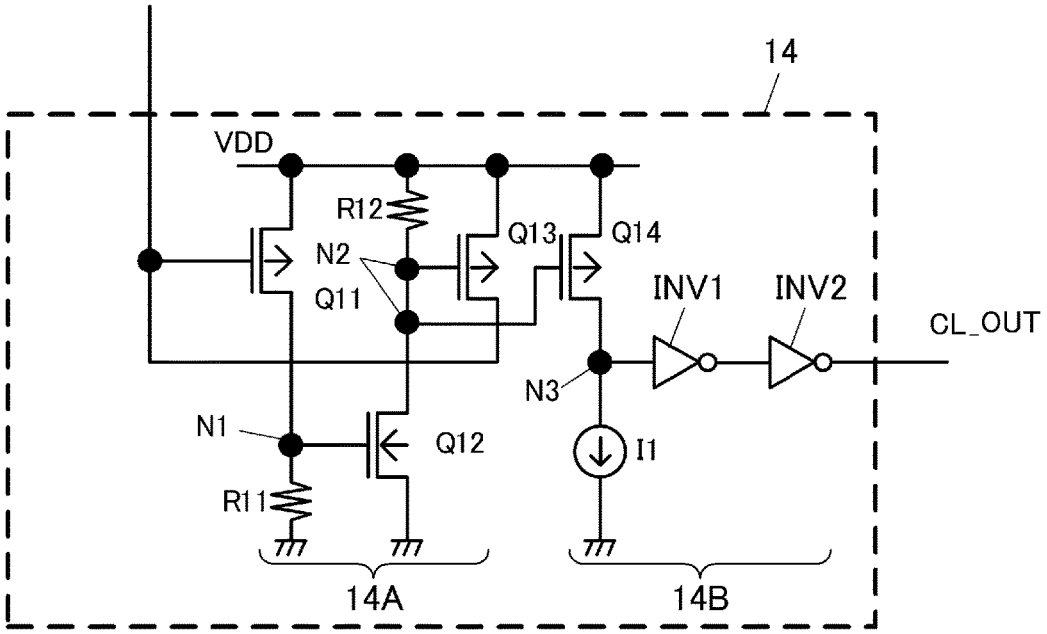
FIG. 4 shows a detailed example of a circuit diagram of the current limit circuit constituting the regulator IC in the embodiment.

FIG. 4 shows a specific example of the current limit circuit 14 that has the foldback current limiting characteristic and that outputs the signal CL_OUT. The signal CL_OUT becomes high while the current limit circuit 14 is active. The current limit circuit 14 in FIG. 4 includes a main circuit part 14A and a signal generating part 14B. The main circuit part 14A performs the primary operation of the current limit circuit. The signal generating part 14B generates and outputs the signal CL_OUT indicating that the main circuit part 14A is active. The configuration shown in FIG. 4 is an example of the current limit circuit and is not limit the present invention.

As shown in FIG. 4, the main circuit part 14A of the current limit circuit 14 in this embodiment includes: a MOS transistor Q11 and a resistor R11 connected in series between the power supply voltage terminal VDD and a ground point; a resistor R12 and a MOS transistor Q12 connected in series between the power supply voltage terminal VDD and a ground point; and a MOS transistor Q13 connected in series between the power supply voltage terminal VDD and the gate terminal of the MOS transistor Q11. The gate terminal of the MOS transistor Q13 is connected to the connecting node N2 that connects the resistor R12 and the transistor Q12. The transistor Q12 is N-MOS, and the transistors Q11, Q13 are P-MOS.

The MOS transistor Q11 is connected such that the transistor Q11 and the voltage-control transistor Q1 in FIG. 1 constitute a current mirror circuit. Accordingly, the current flowing through the transistor Q11 is proportionally smaller than the current Io flowing through the transistor Q1. The gate terminal of the MOS transistor Q12 is connected to the connecting node N1 that connects the transistor Q11 and the resistor R11, so that the transistor Q12 and the resistor R12 operate as a common-source amplifier circuit.

In the main circuit part 14A, as the output current Io increases, the current flowing through the resistor R11 increases, which leads to increase of the voltage of the connecting node N1. the increased voltage of the node N1 is then amplified by the common-source amplifier circuit that consists of the transistor Q12 and the resistor R12. When the transistor Q13 turns on, the main circuit part 14A increases the gate voltage of the voltage-control transistor Q1 to decrease the output current, thereby performing overcurrent protection operation.

The signal generating part 14B includes: a MOS transistor Q14 and a constant current source I1 connected in series between the power supply voltage terminal VDD and a ground point; and inverters INV1, INV2 connected to a connecting node N3 that connects the transistor Q14 and the constant current source I1. The gate terminal of the transistor Q14 and the gate terminal of the transistor Q13 in the main circuit part 14A are connected such that the transistors Q13 and Q14 constitute a current mirror circuit. When the main circuit part 14A performs current limit operation, the transistor Q14 turns on; the electric potential of the connecting node N3 increases; and the output CL_OUT of the inverter INV2 becomes high. The high-level signal CL_OUT of the INV2 indicates that the current limit circuit 14 is active.

(Modifications)

Next, modifications of the regulator IC in the above embodiment are described with reference to FIG. 5 and FIG. 6.

Figure 5:
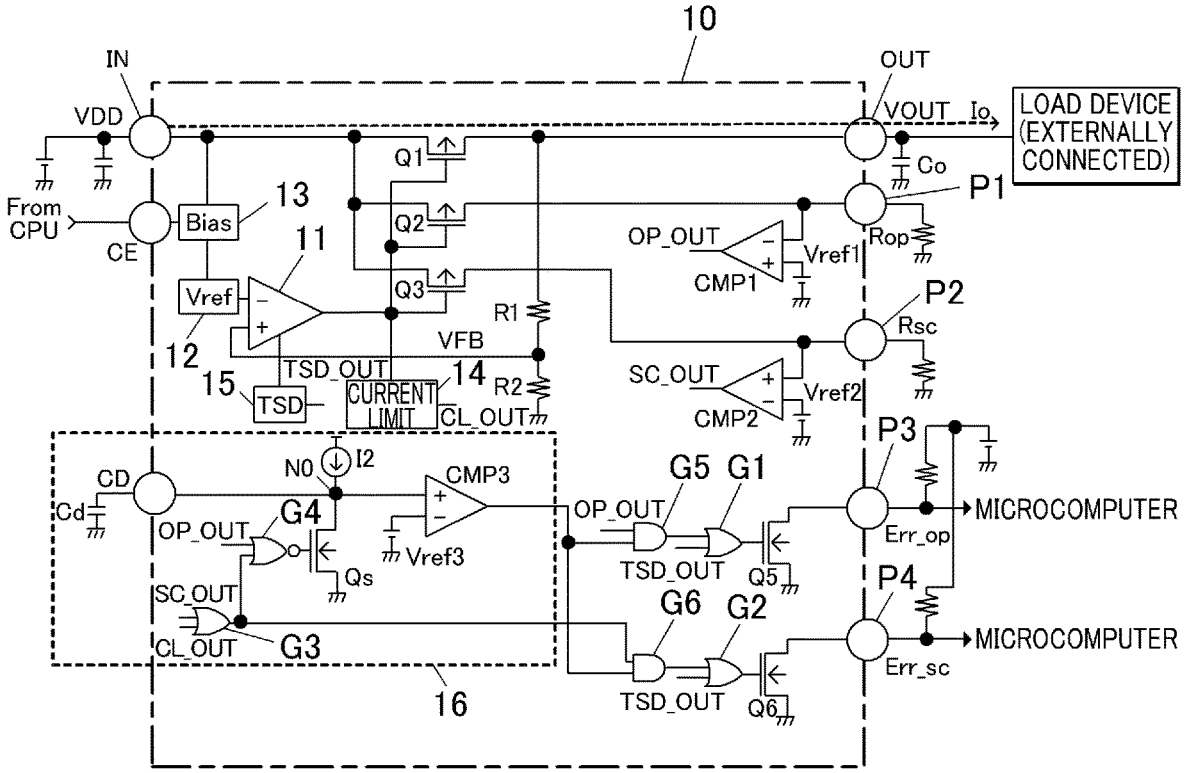
FIG. 5 shows a circuit configuration of a first modification of the regulator IC in the embodiment.

FIG. 5 shows a configuration of the regulator IC in a first modification. The modification in FIG. 5 includes: a delay circuit 16 that delays fault detection signals OP_OUT, SC_OUT; an OR gate G3 that calculates a logical sum of the output SC_OUT of the comparator CMP2 and the output CL_OUT of the current limit circuit 14; and a NOR gate G4 that calculates a logical sum of the output of the OR gate G3 and the output OP_OUT of the comparator CMP1. The OR gates G1, G2 each receive the logical product of the signal delayed by the delay circuit 16 and the signal before being delayed.

The modification including the delay circuit 16 can restrain the comparator CMP2 from outputting detection error pulses owing to a relatively large rush current (inrush current) flowing into the capacitor Co at the output terminal when the regulator IC is activated.

The delay circuit 16 includes: a constant current source 12; a switch transistor Qs connected in series to the constant current source 12; and a comparator CMP3 that receives, as inputs, a predetermined reference voltage Vref3 and the potential of the connecting node N0 that connects the constant current source 12 and the transistor Qs. The gate terminal of the transistor Qs receives the output voltage of the NOR gate G4. The delay circuit 16 further includes an external terminal CD connected to the connecting node N0. The external terminal CD is connected to an external capacitor Cd that is charged by the constant current source I1. Thus, the delay circuit 16 can increase the delay time without increasing the chip size.

In the post-stage of the delay circuit 16, AND gates G5, G6 are provided. The AND gate G5 calculates the logical product of the output of the delay circuit 16 and the undelayed output OP_OUT of the comparator CMP1. The AND gate G6 calculates the logical product of the output of the delay circuit 16 and the output of the OR gate G3.

In the normal operation mode of the regulator IC, the outputs of the comparators CMP1, CMP2 and the output CL_OUT of the current limit circuit 14 are at low level. In the delay circuit 16 under the normal operation mode, the output of the OR gate G3 is at low level and the output of the NOR gate G4 is at high level, and the high-level output of the NOR gate G4 is applied to the gate terminal of the transistor Qs. Thus, in the normal operation mode, the transistor Qs is kept turned on and the capacitor Cd discharges electricity.

When the comparator CMP1 detects that the output terminal is open or the comparator CMP2 detects that the output terminal is short-circuited, the output of either of the comparators CMP1, CMP2 becomes high level, and the output of the NOR gate G4 becomes low level. Accordingly, the transistor Qs turns off. Similarly, when the current limit circuit 14 is active and the output of the current limit circuit 14 becomes high level, the output of the NOR gate G4 becomes low level. Accordingly, the transistor Qs turns off.

Similarly, when the current limit circuit 14 is active and the output of the current limit circuit 14 becomes high level, the output of the NOR gate G4 becomes low level. Accordingly, the transistor Qs turns off.

The capacitor Cd is then gradually charged, and the potential of the connecting node N0 gradually increases. When a predetermined time has passed and the potential of the connecting node N0 becomes higher than the reference voltage Vref3, the output of the comparator CMP3 changes from low-level to high-level. When the comparator CMP1 detects that the output terminal is open, the output of the AND gate G5 changes to high level and the transistor Q5 turns on. Accordingly, the open-circuit-fault detection signal Err_op output by the external terminal P3 changes from high-level to low-level.

When the comparator CMP2 detects that the output terminal is short-circuited or the current limit circuit 14 is active, the output of the AND gate G6 changes to high level and the transistor Q6 turns on. Accordingly, the short-circuit-fault detection signal Err_sc output by the external terminal P4 changes from high-level to low-level. The delay time of the delay circuit 16 is set to be slightly longer than the period of time during which the rush current flows. As described above, the regulator IC including the delay circuit 16 and the AND gates G3, G4 restrains the comparator CMP2 from outputting detection error pulses due to the detection of the rush current.

Figure 6:
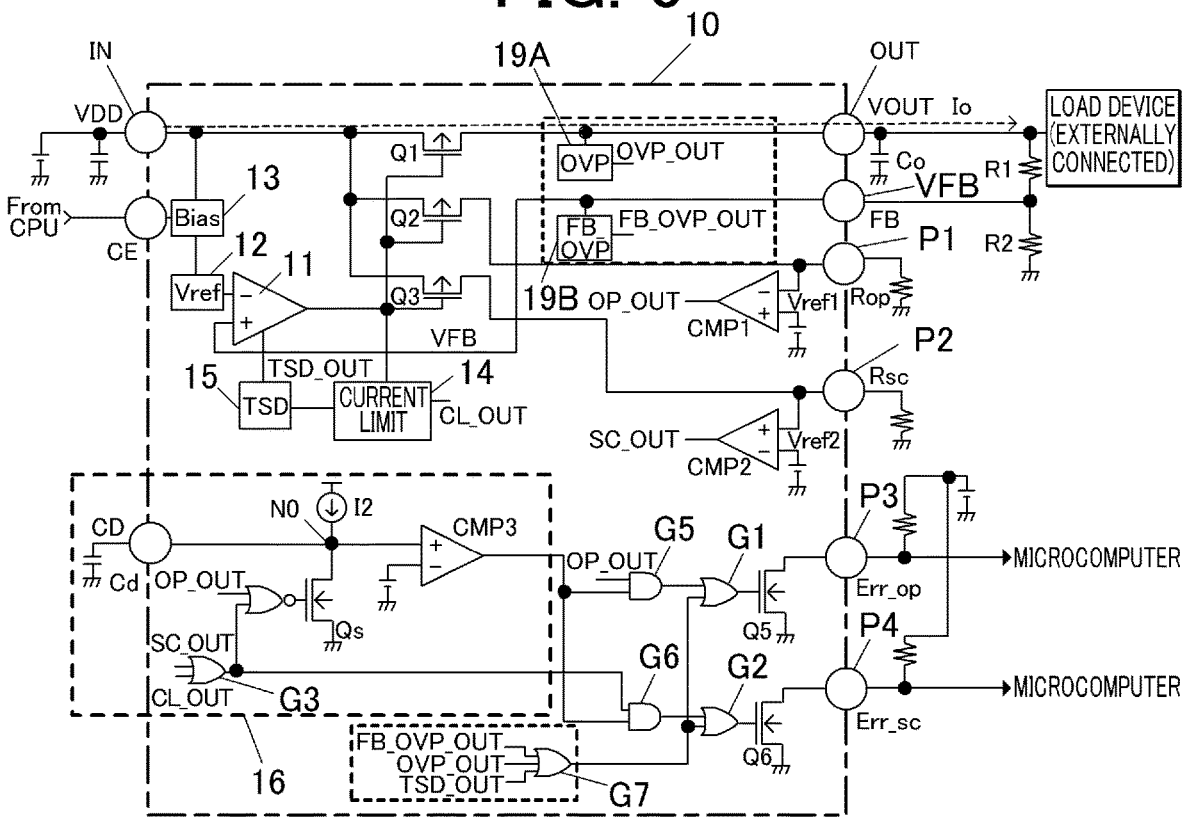
FIG. 6 shows a circuit configuration of a second modification of the regulator IC in the embodiment.

FIG. 6 shows a configuration of the regulator IC in the second modification.

The second modification in FIG. 6 is different from the first modification in FIG. 5 in three aspects.

The first difference is that, in the second modification in FIG. 6, the resistors R1, R2 that divide the output voltage Vout to generate a feedback voltage VFB are external elements connected to the output terminal OUT and that the regulator IC includes an external terminal FB to which the feedback voltage VFB is input. As the resistors R1, R2 are external elements, the value of the output voltage Vout can be adjusted by changing the ratio of the resistor R1 to the resistor R2 outside the regulator IC.

The second difference between the first modification and the second modification is that the second modification in FIG. 6 includes: an overvoltage protection circuit (OVP) 19A that detects the overvoltage of the output terminal Vout and stops the output of the output voltage Vout; and an overvoltage protection circuit (FB_OVP) 19B that detects the overvoltage of the voltage VFB of the external terminal FB and stops the output of the feedback voltage VFB. These overvoltage protection circuits can protect the regulator IC from the overvoltage of the external terminal FB.

The third difference is that the second modification in FIG. 6 includes an OR gate G7 that receives, as inputs, a signal OVP_OUT indicating that the overvoltage protection circuit 19A is active, a signal FB_OVP_OUT indicating that the overvoltage protection circuit 19B is active, and the output TSD_OUT of the thermal shutdown circuit 15 and that the output of the OR gate G7 is input to the OR gates G1, G2. The regulator IC with such a configuration can notify to the outside that the overvoltage protection circuit 19A or 19B is active.

Table 6 below shows the relation of the conditions of the regulator IC in the second modification and the fault detection signals Err_op, Err_sc.

TABLE 6

| | OUTPUT: NORMAL | OPEN | SHORT | OPERATION OF TSD | OPERATION OF OVP | OPERATION OF FB OVP |
|---|---|---|---|---|---|---|
| Err_op | H | L | H | L | L | L |
| Err_sc | H | H | L | L | L | L |

Figure 7A:
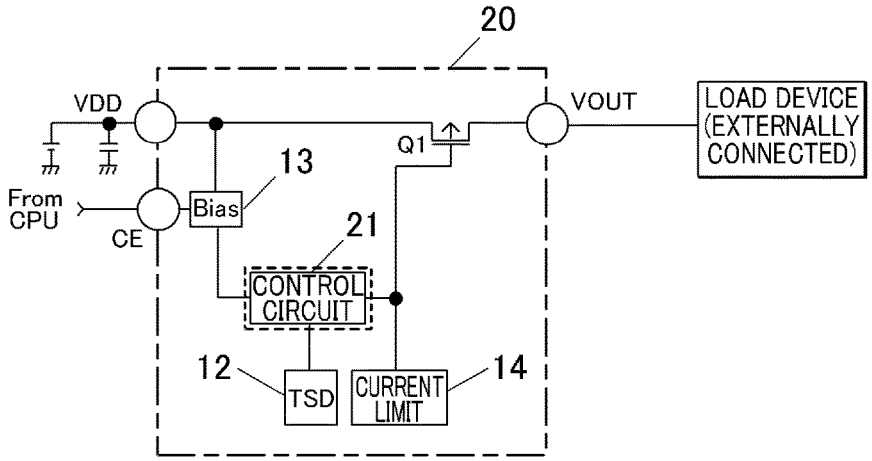
FIG. 7A shows an example circuit configuration of a power supply switch IC.

In the above embodiment, the present invention is applied to a regulator IC. The present invention, however, is also applicable to a power supply switch IC 20 as shown in FIG. 7A. The power supply switch IC 20 supplies the voltage of a power supply device (e.g., battery) to a load without change and shuts down the voltage of the power supply device. The power supply switch IC shown in FIG. 7A includes a gate control circuit 21 instead of an error amplifier. The gate control circuit 21 is configured to control the output transistor Q1 to be fully on or fully off, depending on whether the control terminal CE is at high level or low level.

Figure 7B:
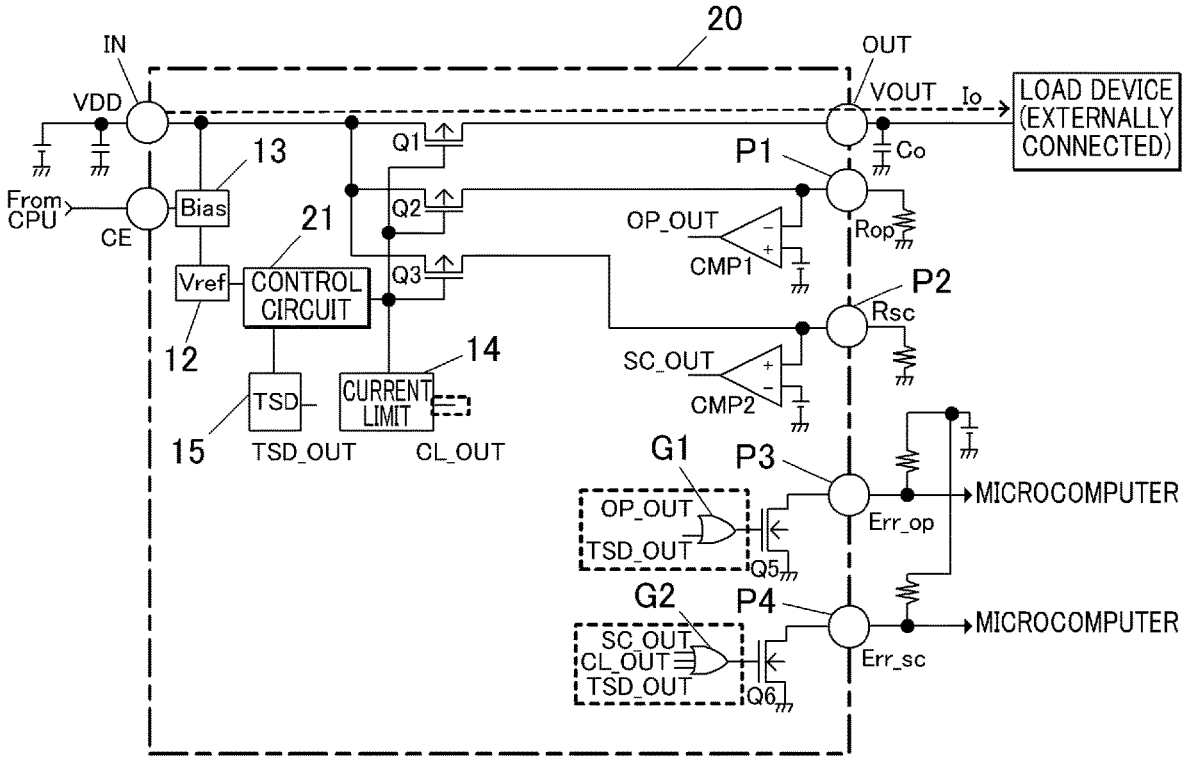
FIG. 7B shows an example circuit configuration of a power supply switch IC that includes an open-circuit-fault detection circuit and a short-circuit-fault detection circuit and to which the present invention is applied.

In FIG. 7B, the present invention is applied to the power supply switch IC in FIG. 7A as an example. The configurations of the regulator IC in FIG. 5 and FIG. 6 can also be applied to the power supply switch IC in FIG. 7A, in a similar way as shown in FIG. 7B. Such a power supply switch IC 20 can achieve similar advantageous effects to the effects of the above-described embodiment.

As described above, according to an aspect of the present invention, a power supply semiconductor integrated circuit includes: an output transistor connected between a voltage-input terminal to which a DC voltage is input and a voltage-output terminal; a control circuit that controls the output transistor based on a feedback voltage of an output voltage; a current limit circuit that limits an output current of the output transistor below a predetermined current limit; a first transistor, the first transistor and the output transistor constituting a current mirror circuit; a short-circuit-fault detection circuit that detects a short circuit of the voltage-output terminal based on a voltage across a resistor element connected in series to the first transistor; and first output terminal that outputs a detection result of the short-circuit-fault detection circuit to outside. The current limit of the current limit circuit is within a current detection range of the short-circuit-fault detection circuit. The short-circuit-fault detection circuit is capable of detecting a short circuit of the voltage-output terminal even while the current limit circuit is limiting the output current.

According to the power supply semiconductor IC configured as described above, the current limit circuit can detect a short-circuit fault and notify the fault to the outside, even when the resistor element connected in series to the first transistor that constitutes a current mirror circuit with the output transistor is short-circuited. Further, the short-circuit-fault detection circuit can detect that the voltage-output terminal is short-circuited even while the current limit circuit is limiting currents. This allows the current limit circuit to have the foldback current limiting characteristic and allows the load device to be protected. This also allows the detection value or the detection range of the short-circuit-fault detection circuit to be around greater currents. Accordingly, the actual usage range of the output current can be widened.

According to another aspect of the present invention, a power supply semiconductor integrated circuit includes: an output transistor connected between a voltage-input terminal to which a DC voltage is input and a voltage-output terminal; a control circuit that controls the output transistor based on a feedback voltage of an output voltage; a current limit circuit that limits an output current of the output transistor below a predetermined current limit; a first transistor, the first transistor and the output transistor constituting a current mirror circuit; a short-circuit-fault detection circuit that detects a short circuit of the voltage-output terminal based on a voltage across a resistor element connected in series to the first transistor; a first output terminal that outputs a detection result of the short-circuit-fault detection circuit to outside; a second transistor, the second transistor and the output transistor constituting a current mirror circuit; an open-circuit-fault detection circuit that detects an open circuit of the voltage-output terminal based on a voltage across a resistor element connected in series to the second transistor; a second output terminal that outputs a detection result of the open-circuit-fault detection circuit to outside; and a thermal shutdown circuit that stops operation of the control circuit in response to detecting a temperature equal to or higher than a predetermined temperature. The first output terminal outputs a signal indicating a fault, based on a signal indicating a logical sum of a signal output by the thermal shutdown circuit and a signal output by the short-circuit-fault detection circuit. The second output terminal outputs a signal indicating a logical sum of the signal output by the thermal shutdown circuit and a signal output by the open-circuit-fault detection circuit.

The power supply semiconductor IC configured as described above can output correct and desired notifications from the first and second output terminals, thereby appropriately notifying faults in response to the thermal shutdown circuit being active, even while the resistor element connected in series to the second transistor is open.

Preferably, the power supply semiconductor integrated circuit may further include a delay circuit that delays an output of the short-circuit-fault detection circuit, wherein the first output terminal outputs a signal indicating a fault, based on a signal indicating a logical product of an output of the delay circuit and the undelayed output of the short-circuit-fault detection circuit.

According to the above configuration, the power supply semiconductor IC can restrain the short-circuit-fault detection circuit from wrongly detecting, as a short-circuit fault of the output terminal, rush currents that flow to charge the output capacitor when the power supply semiconductor IC is activated.

Preferably, the power supply semiconductor integrated circuit may further include a delay circuit that delays an output of the short-circuit-fault detection circuit and an output of the open-circuit-fault detection circuit, wherein the first output terminal outputs a signal indicating a fault, based on a signal indicating a logical product of an output of the delay circuit and the undelayed output of the short-circuit-fault detection circuit, and the second output terminal outputs a signal indicating a fault, based on a signal indicating a logical product of the output of the delay circuit and the undelayed output of the open-circuit-fault detection circuit.

According to the above configuration, the power supply semiconductor IC including the short-circuit-fault detection circuit and the open-circuit-fault detection circuit for the output terminal can restrain the short-circuit-fault detection circuit from wrongly detecting rush currents as a short-circuit fault of the output terminal.

Preferably, the power supply semiconductor integrated circuit may further include a first overvoltage protection circuit that detects a fault and stop an output of the output voltage in response to detecting the fault, wherein the first output terminal is in a state indicating a fault while the first overvoltage protection circuit is active, based on a signal that is output by the first overvoltage protection circuit and that indicates an operation state of the first overvoltage protection circuit.

According to the above configuration, the power supply semiconductor IC including the overvoltage protection circuit can output a notification of a fault from the first and second output terminals to the outside when the overvoltage protection circuit is active. The overvoltage protection circuit may be a circuit that detects an overvoltage of the output voltage of the voltage-output terminal and stops the output.

Preferably, the power supply semiconductor integrated circuit may further include; an external terminal to which the feedback voltage is input; and a second overvoltage protection circuit that detects an overvoltage of the feedback voltage and stops an output of the feedback voltage in response to detecting the overvoltage, wherein the first output terminal is in a state indicating a fault while the second overvoltage protection circuit is active, based on a signal that is output by the second overvoltage protection circuit and that indicates an operation state of the second overvoltage protection circuit.

According to the above configuration, the power supply semiconductor IC including the overvoltage protection circuit that detects an overvoltage of the feedback voltage and stops the output can output a notification of a fault from the first and second output terminals to the outside when the overvoltage protection circuit is active.

According to the present invention, the power supply semiconductor IC includes circuits for detecting short-circuit and open-circuit faults of the output terminal and a thermal shutdown circuit, and can avoid failing to notify the operation state of the thermal shutdown circuit and a short circuit of the output terminal when the external resistor is disconnected from its corresponding terminal. Further, according to the present invention, a current limit circuit having the foldback current limiting characteristic can be used in the power supply semiconductor IC.

Although the present invention has been described in detail on the basis of the embodiment, the present invention is not limited to the above embodiment. For example, although the second modification of the embodiment includes the overvoltage protection circuit (OVP) 19A for the output voltage Vout and the overvoltage protection circuit (FB-OVP) 19B for the voltage VFB of the external terminal P6, the present invention is applicable to a power supply IC that includes only either of the overvoltage protection circuits. Further, although the comparator CMP1 for detecting an open circuit and the comparator CMP2 for detecting a short circuit have hysteresis in the above embodiment, these comparators may not have hysteresis.

In the above embodiment, the transistors constituting internal circuits of the regulator IC 10 and the power supply switch IC 20 are MOS transistors. The transistors, however, may be bipolar transistors instead of MOS transistors. Further, the capacitor Cd for delaying may not be an external element but may be mounted on the IC chip.

Further, the above embodiment includes the current limit circuit 14, the thermal shutdown circuit 15, the overvoltage protection circuit 19A for the output voltage, and/or the overvoltage protection circuit 19B for the feedback voltage, as circuits for protecting the IC. However, the present invention is applicable to a regulator/power supply switch IC that includes other types of protection circuits, such as a circuit that detects an overvoltage of the input voltage and stops operation.

What is claimed is:

1. A power supply semiconductor integrated circuit comprising:

an output transistor connected between a voltage-input terminal to which a DC voltage is input and a voltage-output terminal;

a control circuit that controls the output transistor based on a feedback voltage of an output voltage;

a current limit circuit that limits an output current of the output transistor such that the output current is not equal to or greater than a predetermined current limit;

a first transistor, the first transistor and the output transistor constituting a current mirror circuit;

a short-circuit-fault detection circuit that detects a short circuit of the voltage-output terminal based on a voltage across a resistor element connected in series to the first transistor; and a first output terminal that outputs a detection result of the short-circuit-fault detection circuit to outside, wherein the current limit of the current limit circuit is within a current detection range of the short-circuit-fault detection circuit, and the short-circuit-fault detection circuit is capable of detecting a short circuit of the voltage-output terminal even while the current limit circuit is limiting the output current.

2. The power supply semiconductor Integrated circuit according to claim 1, further comprising a delay circuit that delays an output of the short-circuit-fault detection circuit, wherein the first output terminal outputs a signal indicating a fault, based on a signal indicating a logical product of an output of the delay circuit and an undelayed output of the short-circuit-fault detection circuit.

3. The power supply semiconductor integrated circuit according to claim 1, further comprising a first overvoltage protection circuit that detects a fault and stop an output of the voltage-output terminal in response to detecting the fault, wherein the first output terminal is in a state indicating a fault while the first overvoltage protection circuit is active, based on a signal that is output by the first overvoltage protection circuit and that indicates an operation state of the first overvoltage protection circuit.

4. The power supply semiconductor integrated circuit according to claim 3, wherein the first overvoltage protection circuit detects an overvoltage of the output voltage of the voltage-output terminal and stops the output of the voltage-output terminal in response to detecting the overvoltage.

5. The power supply semiconductor integrated circuit according to claim 1, further comprising;

an external terminal to which the feedback voltage is input; and a second overvoltage protection circuit that detects an overvoltage of the feedback voltage and stops an output of the voltage-output terminal in response to detecting the overvoltage, wherein the first output terminal is in a state indicating a fault while the second overvoltage protection circuit is active, based on a signal that is output by the second overvoltage protection circuit and that indicates an operation state of the second overvoltage protection circuit.

6. A power supply semiconductor integrated circuit comprising:

an output transistor connected between a voltage-input terminal to which a DC voltage is input and a voltage-output terminal;

a control circuit that controls the output transistor based on a feedback voltage of an output voltage;

a current limit circuit that limits an output current of the output transistor such that the output current is not equal to or greater than a predetermined current limit;

a first transistor, the first transistor and the output transistor constituting a current mirror circuit;

a short-circuit-fault detection circuit that detects a short circuit of the voltage-output terminal based on a voltage across a resistor element connected in series to the first transistor;

a first output terminal that outputs a detection result of the short-circuit-fault detection circuit to outside;

a second transistor, the second transistor and the output transistor constituting a current mirror circuit;

an open-circuit-fault detection circuit that detects an open circuit of the voltage-output terminal based on a voltage across a resistor element connected in series to the second transistor;

a second output terminal that outputs a detection result of the open-circuit-fault detection circuit to outside; and a thermal shutdown circuit that stops operation of the control circuit in response to detecting a temperature equal to or higher than a predetermined temperature, wherein the first output terminal outputs a signal indicating a fault, based on a signal indicating a logical sum of a signal output by the thermal shutdown circuit and a signal output by the short-circuit-fault detection circuit, and the second output terminal outputs a signal indicating a logical sum of the signal output by the thermal shutdown circuit and a signal output by the open-circuit-fault detection circuit.

7. The power supply semiconductor integrated circuit according to claim 6, further comprising a delay circuit that delays an output of the short-circuit-fault detection circuit and an output of the open-circuit-fault detection circuit, wherein the first output terminal outputs a signal indicating a fault, based on a signal Indicating a logical product of an output of the delay circuit and an output of the short-circuit-fault detection circuit, and the second output terminal outputs a signal Indicating a fault, based on a signal Indicating a logical product of the output of the delay circuit and the undelayed output of the open-circuit-fault detection circuit.

8. The power supply semiconductor integrated circuit according to claim 6, further comprising a first overvoltage protection circuit that detects a fault and stops an output of the voltage-output terminal in response to detecting the fault, wherein the first output terminal and the second output terminal are in a state indicating a fault while the first overvoltage protection circuit is active, based on a signal that is output by the first overvoltage protection circuit and that indicates an operation state of the first overvoltage protection circuit.

9. The power supply semiconductor integrated circuit according to claim 8, wherein the first overvoltage protection circuit detects an overvoltage of the output voltage of the voltage-output terminal and stops the output of the voltage-output terminal in response to detecting the overvoltage.

10. The power supply semiconductor integrated circuit according to claim 6, further comprising;

an external terminal to which the feedback voltage is input; and a second overvoltage protection circuit that detects an overvoltage of the feedback voltage and stops an output of the voltage-output terminal in response to detecting the overvoltage, wherein the first output terminal and the second output terminal are in a state indicating a fault while the second overvoltage protection circuit is active, based on a signal that is output by the second overvoltage protection circuit and that indicates an operation state of the second overvoltage protection circuit.

* * * * *